United States Patent [19]

Hoffman et al.

[11] Patent Number: 4,886,247

[45] Date of Patent: Dec. 12, 1989

[54] CERAMIC BRICK RETAINER BAND FOR STEEL LADLE

[75] Inventors: Donald B. Hoffman, Florissant, Mo.; Joseph J. Linhart, Granite City; Raymond C. Stoces, Glen Carbon, both of Ill.

[73] Assignee: National Steel Corporation, Pittsburgh, Pa.

[21] Appl. No.: 268,725

[22] Filed: Nov. 8, 1988

[51] Int. Cl.[4] ..... C21C 5/44

[52] U.S. Cl. ..... 266/246; 266/275; 266/280

[58] Field of Search ..... 266/246, 275, 276, 280, 266/285, 286, 287; 432/251, 252

[56] References Cited

U.S. PATENT DOCUMENTS

| | | | |
|---|---|---|---|
| 3,540,713 | 11/1970 | Montgomery | 266/280 |
| 3,894,729 | 7/1975 | Muller | 266/280 |
| 4,155,703 | 5/1979 | Mantey et al. | 266/280 |

*Primary Examiner*—S. Kastler

*Attorney, Agent, or Firm*—O'Neil and Bean

[57] ABSTRACT

A metallurgical ladle including a steel shell and refractory brick lining includes a refractory brick retaining ring formed in segments from a ceramic material, with the segments being releasably secured to the inner surface of the steel shell and overlying the lining brick. The ceramic material preferably is reinforced with metal fiber and preferably has a top surface extending above the open top of the steel shell.

11 Claims, 1 Drawing Sheet

CERAMIC BRICK RETAINER BAND FOR STEEL LADLE

BACKGROUND OF THE INVENTION

1. Field of the Invention

This invention relates to metallurgical ladles and more particularly to an improved metallurgical ladle including a lining brick retaining band formed from ceramic material mounted on the top lip of the ladle shell.

2. Description of the Prior Art

Metallurgical ladles of the type used, for example, in the handling of molten steel have conventionally included a heavy refractory brick lining for the outer steel shell. The refractory brick lining must be able to withstand not only the extreme temperatures encountered in handling of the molten steel and in preheating, but must also have sufficient structural integrity to withstand stresses encountered during pouring, slag skimming and deslagging and any impact loads which may be encountered during handling generally.

In order to provide support for the brick lining at the top of a ladle, it has been conventional practice to provide an inwardly projecting flange, sometimes in the form of one leg of a structural angle welded to the ladle shell adjacent its open end, to overlie and structurally support the uppermost layer of lining brick. The structural steel flange is then protected from the extreme temperatures and from chemical and erosive effects of the slag on molten steel by a layer of castable refractory material. This refractory material conventionally has been retained in position by a plurality of metal anchor members welded to the inwardly projecting flange and extending from its surface to be embedded in the cast refractory layer.

Despite efforts to protect the lining brick retaining structure during use, this prior art system has not been entirely satisfactory since the known castable refractory materials only have a very short life, making it necessary to frequently repair or replace the cast overlay by a spraying or gunning operation to deposit magnesium oxide or other suitable material on the damaged area. This repair procedure is not only expensive because of the cost of the labor and materials, but also because of the necessity of taking a ladle out of service for repairs. Also, as the cast refractory continued to erode, the metal anchors are destroyed, thereby increasing the likelihood that the repair material will not be retained in position. Failure of the insulating cast material can quickly result in destruction of the structural steel retaining flange with the result that the retention support for the lining brick is lost and the brick will fall out during the ladle deslagging process. As a result, ladles employing the known lining brick retaining systems frequently have to be taken out of service for extended periods for repair.

The shortcomings of the prior art ladle brick retaining structures have been greatly magnified when the ladles are used in ladle metallurgy processes requiring a cover to be supported on the top of the ladle during processing. One such ladle metallurgy process now in wide use is disclosed in U.S. Pat. No. 4,560,405 and employs electrodes projecting through a ladle cover for supplying heat to the slag or flux layer during a desulfurizing process. The highly errosive action of the slag, and the extreme temperatures resulting from the electric arc heating process near the top of the ladle result in the slag attacking and rapidly eroding the known prior art lining brick retaining structures. Further, loads applied by the ladle cover required substantial strength as well as a relatively smooth top surface to support and maintain a seal with the ladle cover during such ladle metallurgy processes.

SUMMARY OF THE INVENTION

In accordance with the present invention, the necessity for repeated application of sprayed or gunned insulating refractory material to protect the lining brick retaining structure has been eliminated and the useful life of the brick retention system is greatly extended. As a result, the ladles may be used for a greatly extended period of time without taking the ladle out of service for repair of the lining brick. This is accomplished by providing a heat and erosive resistent lining brick retaining band which is bolted directly to the top lip portion of the ladle shell and overlying the lining brick to firmly support and retain the brick in position during ladle deslagging process. In addition, the retaining ring may extend outwardly over the top lip of the ladle to provide a relatively wide, stable support surface for a ladle cover of the type frequently used in ladle metallurgy processes. The retaining band is formed from a cast, reinforced ceramic material which is resistent to attack by slag and molten metal and which has sufficient strength to resist damage during use. The reinforced ceramic material also provides excellent resistance to cracking as a result of thermal shock and is abrasion resistent to provide a long useful life.

The improved brick retaining band is preferably formed in a plurality of sections each independently supported on the ladle shell so that individual sections may be replaced as necessary, thereby affecting substantial savings in repair costs and ladle downtime. Further, individual sections of the retaining band, such as the section exposed to molten slag during slag skimming or deslagging operations can be formed of a heavier section, thereby extending the useful life of the retaining band.

BRIEF DESCRIPTION OF THE DRAWINGS

Further features and advantages of the present invention will be apparent from the detailed description contained hereinbelow, taken in conjunction with the drawings, in which.

DESCRIPTION OF THE PREFERRED EMBODIMENT

Figure 2:
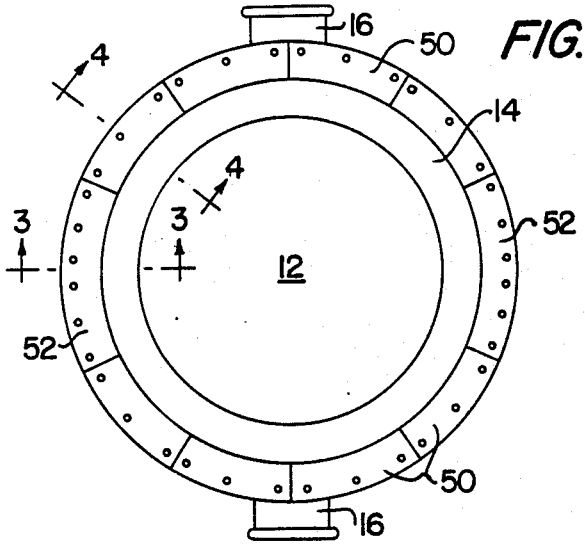
Fig 2. is a top plan view of the ladle shown in FIG. 1.

Referring now to the drawings in detail, a metallurgical ladle of the type conventionally employed for the handling of molten steel is designated generally by the reference numeral 10 and includes a refractory lined bottom wall 12 and a continuous upwardly extending, outwardly sloping refractory lined side wall 14. Lifting trunions 16 are provided on diametrically opposed sides of the ladle and a tilting lug 18 is rigidly welded on and projects outwardly from side wall 14 near the bottom thereof at a location 90° from the axis of trunions 16. A deslagging linkage 20 is provided on the side of the ladle opposite the tilting lug 18.

Figure 4:
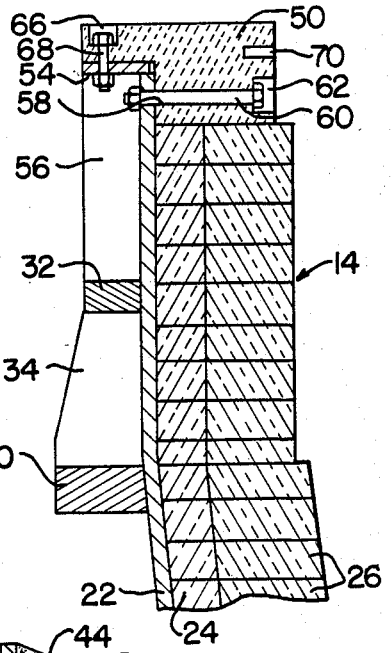
FIG. 4 is a view similar to FIG. 3 and taken on line 4—4 of FIG. 2.
Figure 3:
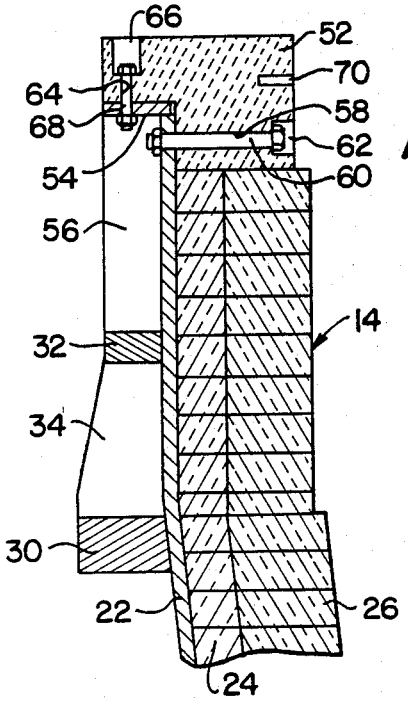
FIG. 3 is an enlarged fragmentary sectional view taken on line 3—3 of FIG. 2.
Figure 5:
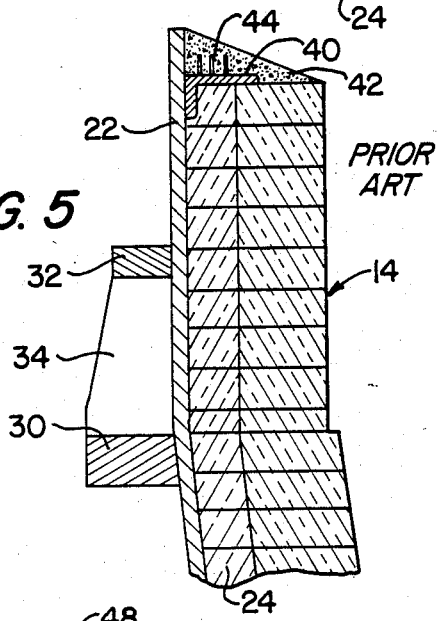
FIG. 5 is a view similar to FIGS. 3 and 4 and showing a prior art ladle lining retention system.

Referring to FIGS. 3–5, it is seen that the side wall 14 comprises an outer steel sheel 22 and a refractory lining consisting of a first layer of heat insulating safety brick 24 disposed in contact with the inner surface of shell 22 and an inner layer or wall of refractory working bricks, or blocks 26. The outer surface of shell 22 is normally reinforced with circumferentially extending rings such as illustrated at 28, 30 and 32. Gussets 34 may be provided between the reinforcing rings, and a heavy reinforcing plate 36 is provided at the base of the trunions 16.

FIG. 5 illustrates a prior art ladle lining brick retaining system employing a structural angle 40 mounted as by welding on the inner surface of shell 22 and extending completely therearound in downwardly spaced relation to the open top of the ladle. The angle 40 includes a horizontal leg having a length sufficient to completely overlay the inner layer of safety brick 24 and a portion of the inner lining of refractory brick 26 to firmly support the refractory lining and prevent the brick from being dislodged during the deslagging. To protect the structural steel angle from attack by hot slag and molten metal, an annular layer of refractory material 42 extends from the inner top edge of the refractory lining 26 to the top of shell 22, and a plurality of metal anchor members 44 welded to and projecting upwardly from the angle member 40 are embedded in the castable refractory 42 to assist in retaining the material in place. As previously stated, this layer of castable refractory material is subject to severe thermal stresses with the result that it frequently cracks and portions fall away during deslagging. Also, the slag attacks and erodes the refractory, making it necessary to frequently repair the material by a spraying or gunning operation to restore its insulating capability. Without benefit of the anchors 44, however, the gunned or sprayed refractory often will not stick and it is necessary to take the ladle out of service for repair at frequent intervals.

Figure 1:
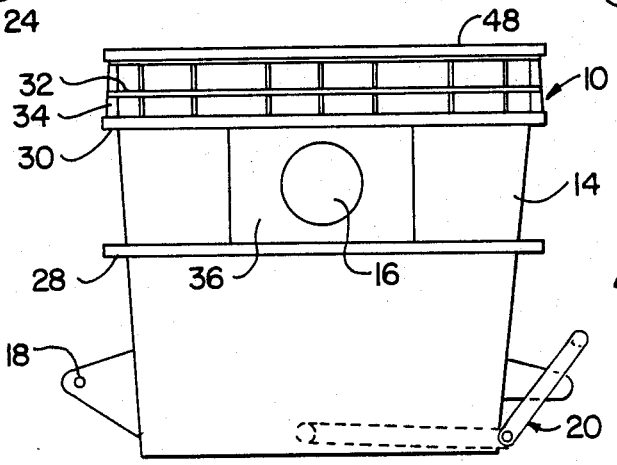
FIG. 1 is a side elevation view of a steel ladle embodying the present invention.

Referring now to FIGS. 1–4, in accordance with the present invention, the ladle lining bricks are retained by a preformed, segmented ceramic ring 48 mounted on the top portion of shell 22. In a ladle having a circular horizontal cross section as illustrated in FIGS. 1 and 2, the top ring 48 preferably comprises a plurality of substantially identical ring segments 50 at each trunion side of the ladle and a longer and preferably thicker ring segment 52 at the locations 90° from the trunion axis. This arrangement enables tilting of the ladle in either direction about the trunion axis for slag skimming or deslagging, or to pour metal from the ladle, without the stream of slag or metal flowing directly across a ring joint.

As shown in FIG. 3, ring segment 52 may be described as having a generally rectangular cross section with one corner portion removed to provide a recessed seat or notch to facilitate attachment to the ladle shell 22. This configuration provides, in effect, a heavy annular ring portion overlying and supporting the ladle lining and an integral outwardly extending flange portion overlying and extending outwardly from the top edge of shell 22. Also, a continuous flat steel ring 54 is rigidly welded to and projects outwardly from the top of shell 22 to provide a continuous supporting ledge for the overlying flange, and gussets 56 are provided at spaced points around the ladle between flange 54 and reinforcing ring 30 thereby rigidly supporting the outwardly extending portion of the ring segment.

The body of ring segment 52 is provided with a series of horizontally extending bores 58 for receiving mounting bolts 60 which extend through openings in shell 22 for rigidly mounting the ring segment onto the shell with its downwardly directed horizontal surface firmly engaging the top surface of the top layer of lining brick 24, 26. A counterbore 62 is provided on the inwardly directly vertical surface of the ring segment 52, at each bore 58, to receive the heads of the mounting bolts 60. In use, after the ring segments and bolts are installed, the counterbore 62 will be filled with a suitable castable refractory material to protect the high strength, high temperature bolt from attack by the slag and molten metal. A similar series of vertically extending bores 64 and counterbores 66 are provided in the laterally extending flange portion of ring segment 52 for receiving bolts 68 to clamp the ring segment to the horizontally extending ledge 54, thereby firmly anchoring the ring segment in two directions and providing continuous support both horizontally and vertically. Counterbores 66 are also normally filled with a castable refractory material after the bolts 68 are installed.

Referring now to FIG. 4, it is seen that ring segments 50 are substantially identical to the ring segments 52 just described except that the segments 50 are of reduced thickness in the vertical direction. This reduced thickness in the side areas of the ladle is made possible by the fact that these segments are not subjected to the severe thermal stresses and shock loads encountered by the segments 52 during slag skimming and deslagging operations. In practice, in order for the top surfaces of the segments 50, 52 to lie in a common plane, thereby presenting a smooth continuous top surface for the ladle ring 48, the ladle shell 22 and lining brick are preferably of reduced height in the area of ring segments 52.

The ring segments 50, 52 are cast from a high strength, high temperature ceramic material. In practice, it has been found that alumina reinforced with stainless steel fiber provides excellent strength and wear characteristics enabling use of the ladle for substantially greater periods between servicing than could be achieved by the prior art system. For example, ladles of the type employed in the ladle metallurgy process described in the abovementioned U.S. Pat. No. 4,560,405 employing the prior art lining brick retaining system frequently had to be taken out of service for repair after ten or fewer heats. By contrast, a ladle embodying the present invention used in the same process can normally be employed to process up to 120 or more heats before it is necessary to replace one or both the ring segments 52 which are subjected to the most severe stresses and erosive effects of the slag. The ring segments 50 may have a service life which is substantially double that of the segments 52.

While various ceramic and reinforcing materials may be employed to form the ring segment of the present invention, it has been found that a composition consisting of about 85% alumina with 15% stainless steel fiber reinforcing provides an excellent result. The reinforcing material not only provides the desired static or structural strength but also makes the cast structure highly resistent to thermal shock.

The relatively wide top surface of the continuous ring 48 defined by the plurality of ring segments 50, 52 provides a high strength, stable support for a ladle cover when the ladle is used in a ladle metallurgy process requiring such cover. By use of a high temperature, high strength castable ceramic, the retaining system resists damage from the high temperature produced by the electric arc heating of the slag in such a ladle metallurgy process.

Repair of a ladle employing the present invention by replacing a damaged ring segment merely requires the ends of bolts 60 and 68 to be burned off with a torch to enable the damaged segment to be lifted from the ladle. For this purpose, a series of lifting holes 70 are provided in the inner and outer vertical faces of each ring segment to facilitate handling by suitable overhead cranes or the like. For convenience of illustration, only one lifting hole 70 is shown in FIG. 3 and in FIG. 4, it being understood that at least two such lifting holes will be provided on both the inner and outer vertical faces of each ring segment.

While a preferred embodiment of the invention has been disclosed and described, it should be apparent that the invention is not so limited, and it is intended to include all embodiments thereof which would be apparent to one skilled in the art and which come within the spirit and scope of the invention.

We claim:

1. In a metallurgical ladle having a bottom wall and an upwardly extending sidewall, trunion means for supporting the ladle for tilting movement about a horizontal axis located in a vertical centerplane of the ladle, the sidewall including an outer steel shell terminating in an open top and an inner lining of refractory brick covering the inner surface of said shell, and brick retaining means on said shell and overlying the inner lining to retain the refractory brick in position when the ladle is tilted about its trunion axis for slag skimming, metal pouring or deslagging, the improvement wherein said lining brick retaining means comprises, a plurality of separately formed retaining ring segments adapted to be mounted on the inner surface of said shell, mounting means releasably mounting said ring segments on the inner surface of said shell adjacent said open top in abutting end-to-end relation to one another to define a substantially continuous retaining ring, each said retaining ring segment having a bottom surface overlying a portion of said refractory brick lining to retain the brick in position and a top substantially horizontal surface extending above said open top of said shell, said retaining ring segments being formed from a high strength heat resistant ceramic material which is resistant to attack by slag and hot metal contained in the ladle, an outwardly extending ledge on said shell at said open top, and at least selected ones of said segments including a portion extending outwardly above said open top and engaging said ledge.

2. The invention defined in claim 1 wherein said mounting means comprises bolt means extending through substantially horizontal openings in said ring segments and in said shell.

3. The invention defined in claim 2 further comprising bolt means extending through generally vertical openings in said ring segments and said ledge.

4. In a metallurgical ladle having a bottom wall and an upwardly extending sidewall, trunion means for supporting the ladle for tilting movement about a horizontal axis located in a vertical centerplane of the ladle, the sidewall including an outer steel shell terminating in an open top and an inner lining of refractory brick covering the inner surface of said shell, and brick retaining means on said shell and overlying the inner lining to retain the refractory brick in position when the ladle is tilted about its trunion axis for slag skimming, metal pouring or deslagging, the improvement wherein said lining brick retaining means comprises, a plurality of separately formed retaining ring segments adapted to be mounted on the inner surface of said shell, mounting means releasably mounting said ring segments on the inner surface of said shell adjacent said open top in abutting end-to-end relation to one another to define a substantially continuous retaining ring, each said retaining ring segment having a bottom surface overlying a portion of said refractory brick lining to retain the brick in position and a top substantially horizontal surface extending above said open top of said shell, said substantially continuous ring comprises one ring segment mounted on said shell at a position symmetrical about a vertical plane perpendicular to said trunion axis and extending around said open top for a sufficient distance whereby slag or molten metal poured from the ladle upon tilting the ladle about said trunion axis will flow over said one ring segment only, said retaining ring segments being formed from a high strength heat resistent ceramic material which is resistent to attack by slay and hot metal contained in the ladle.

5. The invention defined in claim 4 wherein said ring segments are formed from a ceramic material reinforced with metal fiber.

6. The invention defined in claim 5 wherein said ceramic material comprises about 85% alumina and about 15% steel fiber.

7. The invention defined in claim 6 further comprising an outwardly extending ledge on said shell at said open top, and at least selected ones of said segments including a portion extending outwardly above said open top and engaging said ledge.

8. The invention defined in claim 7 wherein said mounting means comprises bolt means extending through substantially horizontal openings in said ring segments and in said shell.

9. The invention defined in claim 8 further comprising bolt means extending through generally vertical openings in said ring segments and said ledge.

10. The invention defined in claim 9 wherein said substantially continuous ring comprises a ring segment mounted on said shell at a postion symmetrical about a vertical plane perpendicular to said trunion axis whereby slag or molten metal poured from the ladle will flow over a continuous ring segment.

11. The invention defined in claim 4 wherein at least said one ring segment includes a portion extending outwardly above said open top.

* * * * *